United States Patent [19]

Tazuke et al.

[11] Patent Number: 4,807,673

[45] Date of Patent: Feb. 28, 1989

[54] APPARATUS FOR FILLING LIQUIDS

[75] Inventors: Hisashi Tazuke; Kazunori Araki; Shogo Yamaguchi; Sueshige Nakamura; Sadahiro Abe, all of Nagoya, Japan

[73] Assignee: Mitsubishi Jukogyo Kabushiki Kaisha, Tokyo, Japan

[21] Appl. No.: 98,468

[22] Filed: Sep. 18, 1987

[30] Foreign Application Priority Data

Sep. 30, 1986 [JP] Japan ..... 61-229747

[51] Int. Cl.[4] ..... B67C 3/04

[52] U.S. Cl. ..... 141/57; 141/5

[58] Field of Search ..... 137/572, 575; 141/6, 141/40, 46, 52, 57, 198; 222/424.5

[56] References Cited

U.S. PATENT DOCUMENTS

| | | | |
|---|---|---|---|
| 1,387,507 | 8/1921 | Muller | 141/46 |
| 3,381,723 | 5/1968 | Quest | 141/39 |
| 3,877,358 | 4/1975 | Karr | 141/6 X |

*Primary Examiner*—Stephen Marcus

*Attorney, Agent, or Firm*—Wenderoth, Lind & Ponack

[57] ABSTRACT

An apparatus for filling a container with drink liquid from a pressurized liquid-storage tank through a filling valve includes an auxiliary tank releasable to the air and provided between the liquid-storage tank and the filling valve. The auxiliary tank is communicated with the liquid-storage tank and the filling valve. After reducing the pressure in the auxiliary tank to atmospheric pressure by opening an air releasing valve installed in the auxiliary tank, drink liquid, which was supplied from the liquid-storage tank to the auxiliary tank in advance, is supplied from the auxiliary tank to the container via the filling valve.

2 Claims, 1 Drawing Sheet

APPARATUS FOR FILLING LIQUIDS

BACKGROUND OF THE INVENTION

1. Field of the Invention

The present invention relates to an apparatus for filling liquids, by which a container is filled with a drink liquid such as a carbonic acid drink or the like in a pressurized liquid-storage tank through a filling valve.

2. Prior Art

Description will now be made of a prior art apparatus for filling liquids, with reference to FIG. 2, in which reference numeral (01) denotes a liquid-storage tank (main liquid tank) storing therein a carbonic acid drink liquid with which a container (06) is to be filled, and the liquid-storage tank (01) is under an internal pressure of approx 5 kg/cm$^2$. The liquid-storage tank (01) consists of a gas phase pressure chamber (08) and a liquid phase section (09), and the pressure in the gas phase chamber (08) and the liquid level in the liquid phase section (09) are controlled by a known control means. Reference numeral (02) denotes a filling valve communicating with the liquid phase section (09) in the liquid-storage tank (01), reference numeral (03) denotes another filling valve (a counter valve) communicating with the gas phase pressure chamber (08) in the liquid-storage tank (01), reference numeral (04) denotes a filling nozzle extending from filling valve (02), reference numeral (06) denotes the container such as a bottle, can or the like, reference numeral (07) denotes a pressurized gas supply pipe extending from the filling valve (03), reference numeral (05) denotes a seal member fixed to the filling nozzle (04) and the gas supply pipe (07), and reference numeral (010) denotes a container stand provided with an elavating mechanism such as an air cylinder or the like. By the action of the container stand (010), the container (06) is supplied to a position beneath the filling nozzle (04) and is elevated to insert the filling nozzle (04) and the pressure gas supply pipe (07) into the container (06), while an opening of the container (06) is closed in an airtight manner the seal member (05). Subsequently the filling valve (03) is opened to supply the pressurized gas (pressurized air, carbonic acid gas or the like) in the liquid-storage tank (01) to the container (06) via the filling valve (03) and the gas supply pipe (07), whereby the interior of the liquid-storage tank (01) and the interior of the container (06) are maintained at the same pressure, for example at a pressure of 5 kg/cm$^2$G. Then, by opening the filling valve (02), carbonic acid drink liquid in the liquid-storage tank (01) is supplied into the container (06) via the filling valve (02) and the filling nozzle (04). At this time, the seal member (05) prevents the pressurized gas, which is being supplied into the container (06), from leaking to the exterior. When the filling is completed, the pressure in the container (06) is reduced by a means not shown to atmospheric pressure, and subsequently the container stand (010) is moved down to release the container (06) from the seal member (05), the filling nozzle (04) and the gas supply pipe (07).

In the conventional apparatus for filling liquids shown in FIG. 2, by the container stand (010) provided with the elevation mechanism, the container (06) is moved upward to the filling position, the filling nozzle (04) and the gas supply pipe (07) are inserted into the container (06), the opening of the container (06) is closed in an airtight manner by the seal member, and then the pressurized gas (pressurized air, carbonic acid gas or the like) is supplied into the container (06). Therefore, unless the container stand (010) has an upward force F resisting the pressure of pressurized gas, the container stand (010) and the container (06) will move downward, with a gap being caused between the seal member (05) and the opening of the container (06), whereby the pressurized gas in the container (06) leaks to the exterior. In other words, it is impossible to maintain the same pressure both in the container (06) and the liquid-storage tank (01), and therefore there is caused an inconvenience such as foaming or the like at the time of the process for filling the carbonic acid liquid which is performed subsequently to the above process of filling the pressurized gas.

In case of the container being a bottle, the upward force F of the container stand (010) is 60 kg. However, in case of the container being a 100 mm diameter can, the upward force F of the container stand (010) becomes approx. 300 kg at a gas pressure of 4 kg/cm$^2$, and it is difficult to apply an upward force of approx. 300 kg to the container stand (010). Further, the upward force F is applied to the seal member (05), whereby a high strength is required for the filling nozzle (04) and the pressurized gas supply pipe (07), and thus such elements have to be constructed very strongly.

The supply of pressurized gas into the container (06) means that high strength is required of the container (06). That is to say, there were problems of causing breaking in case of container (06) being a bottle and of causing deformation in case of container (06) being a synthetic resin container or the like.

SUMMARY OF THE INVENTION

For solving the foregoing prior art problems, an object of the present invention is to provide an apparatus for filling liquids, wherein it is not necessary to seal airtightly the opening of the container, and high strength is not required of the container stand and valve.

It is another object of the present invention to provide an improved apparatus for filling liquids, wherein it is possible to prevent damage to and deformation of containers.

In order to achieve the foregoing objects, the present invention provides an improved apparatus for filling a container with drink liquid from a pressurized liquid-storage tank through a filling valve, wherein an auxiliary tank releasable to the air is provided between the liquid-storage tank and the filling valve, the auxiliary tank being communicated with the liquid-storage tank and the filling valve.

The advantages of the present invention will be more fully understood from the following description of a preferred embodiment and with reference to the drawings.

DETAILED DESCRIPTION OF THE PREFERRED EMBODIMENT

Figure 2:
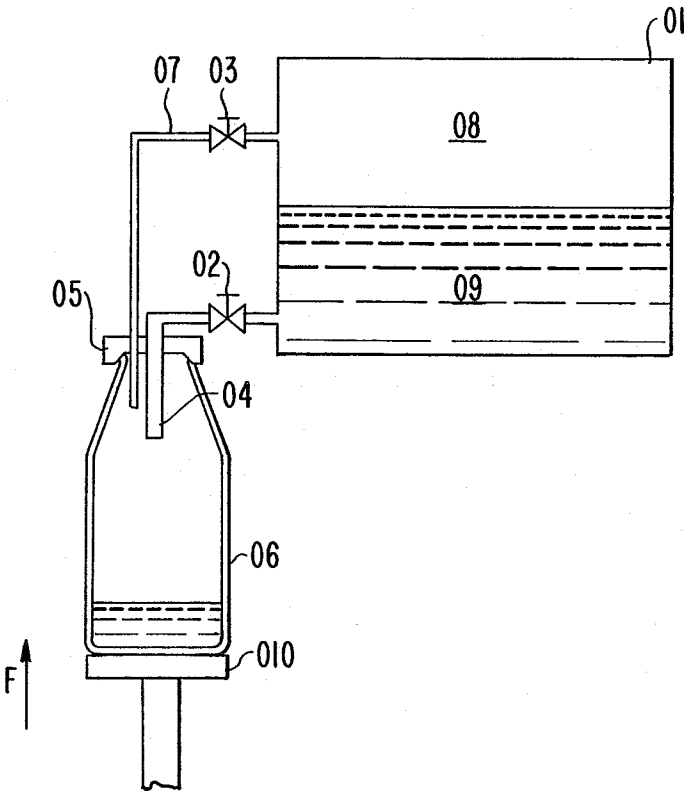
FIG. 2 PRIOR ART
FIG. 2 is a vertical side view showing a conventional apparatus for filling liquids.
Figure 1:
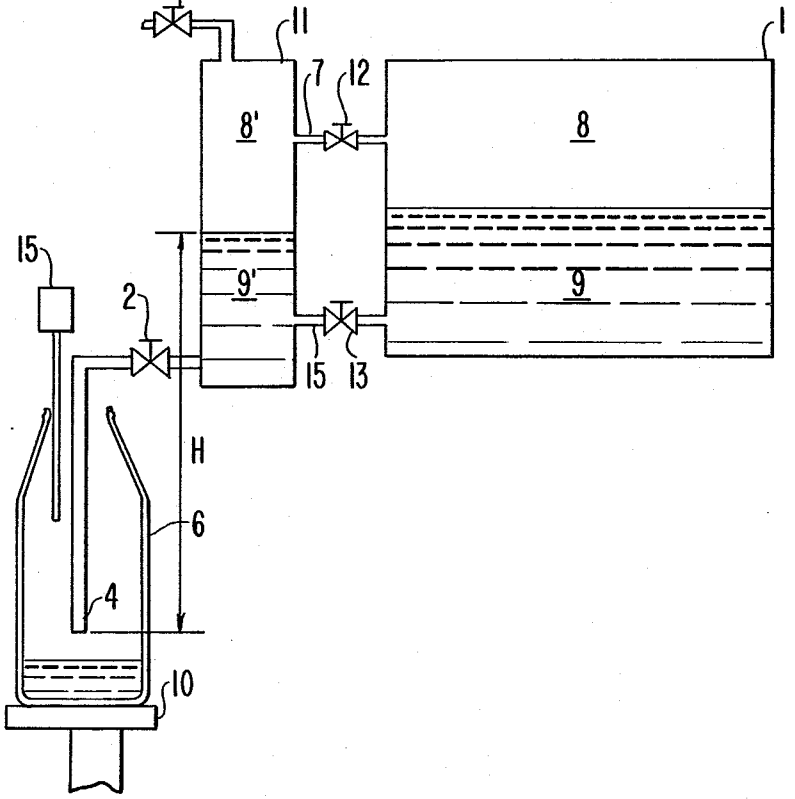
FIG. 1 is a vertical side view showing one embodiment of an apparatus for filling liquids according to the present invention.

Now, description will be made of an apparatus for filling liquids of the present invention with reference to one embodiment shown in FIG. 1, wherein reference numeral (1) denotes a liquid-storage tank (a main liquid tank) in which carbonic acid drink liquid, with which a container (6) is to be filled, is stored and the interior of the liquid-storage tank (1) is under a pressure of approx. 5 kg/cm$^2$. The liquid-storage tank (1) consists of a gas phase pressure chamber or section (8) and a liquid phase section (9), with the pressure in the gas phase pressure chamber (8) and the liquid level in the liquid phase section (9) being controlled by a known control means. Reference numeral (11) denotes an auxiliary tank, reference numeral (8') denotes a gas phase section in the auxiliary tank (11), reference numeral (9') denotes a liquid phase section in the auxiliary tank (11), reference numeral (7) denotes a gas supply pipe which connects the gas phase section (8') in the auxiliary tank (11) with the gas phase section (8) in the liquid-storage tank (1), reference numeral (16) denotes a liquid supply pipe which connects the liquid phase section (9') in the auxiliary tank (11) with the liquid phase section (9) in the liquid-storage tank (1), and reference numeral (12) denotes an automatic on-off valve which is installed in the gas supply pipe (7). When the automatic on-off valve (12) is opened, gas pressure in the auxiliary tank (11) becomes the same as that in the liquid-storage tank (1), while the gas pressure in the auxiliary tank (11) is controlled by an air releasing automatic on-off valve (14) installed in the auxiliary tank (11) when the automatic on-off valve (12) is closed. Reference numeral (13) denotes an automatic on-off valve which is installed in the liquid supply pipe (16). When the automatic on-off valve (13) is opened, carbonic acid drink liquid in the liquid-storage tank (1) is supplied into the auxiliary tank (11), while the supply of the carbonic acid drink liquid from the liquid-storage tank (1) into the auxiliary tank (11) is stopped when the automatic on-off valve (13) is closed. Reference numeral (2) denotes a filling valve communicating with the liquid phase section (9') in the auxiliary tank (11), reference numeral (4) denotes a filling nozzle extending from the filling valve (2), reference numeral (6) denotes a container such as a bottle, can or the like, reference numeral (10) denotes a container stand provided with an elevation mechanism such as an air cylinder or the like, and reference numeral (15) denotes a liquid level sensor detecting the liquid level in the container (6). Each detection signal obtained by the liquid level sensor (15) is sent to the filling valve (2) so as to close the filling valve (2).

Next, description will be made of the operation of the apparatus for filling liquids shown in FIG. 1. By closing the air releasing automatic on-off valve (14) and opening the automatic on-off valve (12), the interior of the liquid-storage tank (1) and the interior of the auxiliary tank (11) are made to be at the same pressure, for example 5 kg/cm$^2$G, when the filling valve (2) and the automatic on-off valve (13) are closed. Subsequently, by opening the automatic on-off valve (13), the carbonic acid drink liquid (9) in the liquid-storage tank (1) is supplied into the auxiliary tank (11) via the liquid supply pipe (16), and when a predetermined amount of the drink liquid is supplied into the auxiliary tank (11), the automatic on-off valve (13) is closed. Then, the automatic on-off valve (12) is closed to isolate the gas phase section (8) in the liquid-storage tank (1) from the gas phase section (8') in the auxiliary tank (11). In this isolated state, it follows that the auxiliary tank (11) has independent gas phase (8') and liquid phase sections (9'). When this state is accomplished, the air releasing automatic on-off valve (14) is opened gradually, whereby the pressure in the auxiliary tank (11) is reduced to atmospheric pressure according to a predetermined pressure-reduction curve. Subsequently, by opening the filling valve (2), the carbonic acid drink liquid (9') in the auxiliary tank (11) is supplied into the container (6), into which the filling nozzle (4) is already inserted. At this time, the pressure in the auxiliary tank (11) is already reduced to atmospheric pressure, and therefore there is no need of carrying out filling by pressurizing the interior of the container (6), unlike the conventional apparatus, while the filling velocity is determined by the water head H from the liquid level of the auxiliary tank (11) to the lower end section of the filling nozzle (4) and by the pressure losses in the filling nozzle (4) and the filling valve (2), whereby the velocity is not so high as to cause foaming of the liquid with which the container is filled. When the container (6) is filled with the carbonic acid drink liquid (9') to a predetermined liquid level, the liquid level sensor (15) detects such state and the detection signal obtainable at this time is sent to the filling valve (2), whereby the filling valve (2) is closed. Then, the air releasing automatic on-off valve (14) is closed to bring the apparatus to the state in which the auxiliary tank (11) waits for the supply of gas and liquid from the liquid-storage tank (1). The filling valve (2) and the filling nozzle (4) may be integrated into the body. In other words, the filling valve (2) may be installed in the filling nozzle (4).

From the description referred to above, in an apparatus for filling liquids according to the present invention, after reducing the pressure in the auxiliary tank to atmospheric pressure by opening the air releasing valve installed in the auxiliary tank, the drink liquid, which was supplied from the liquid-storage tank to the auxiliary tank in advance, is supplied from the auxiliary tank to the container via the filling valve and the filling nozzle. Therefore, there is no need of sealing airtightly the opening of the container, while high strength is not required for the container stand and the valve. As described above, the filling is carried out under atmospheric pressure, whereby the present invention has further effects of preventing the containers from being damaged and deformed.

The foregoing preferred embodiment is considered illustrative only. Numerous other modifications and changes will readily occur to those persons skilled in the art after reading the foregoing specification. Consequently, the disclosed invention is not limited to the exact construction and use shown and described above, and the scope of the invention is to be determined from the appended claims.

What is claimed is:

1. In an apparatus for filling containers with carbonated liquid, said apparatus including a pressurized liquid storage tank for containing liquid in a liquid phase section and pressurized gas in a gas phase pressure chamber, and a filling valve for supplying carbonated liquid to a container to be filled, the improvement comprising:

an auxiliary tank including a liquid phase section connected to said liquid phase section of said pressurized liquid storage tank to receive liquid therefrom and a gas phase section connected to said gas phase pressure chamber of said pressurized liquid storage tank to receive pressurized gas therefrom;

means for isolating said gas phase section of said auxiliary tank from said gas phase pressure chamber of said pressurized liquid storage tank and for isolating said liquid phase section of said auxiliary tank from said liquid phase section of said pressurized liquid storage tank;

means for, upon said isolation of said auxiliary tank from said pressurized liquid storage tank, reducing the pressure in said auxiliary tank to atmospheric pressure; and said filling valve being connected to said liquid phase section of said auxiliary tank such that carbonated liquid may be filled into a container to be filled at atmospheric pressure by opening said filling valve.

2. The improvement claimed in claim 1, wherein said isolating means comprises a first shut-off valve between said gas phase pressure chamber of said pressurized liquid storage tank and said gas phase section of said auxiliary tank, and a second shut-off valve between said liquid phase section of said pressurized liquid storage tank and said liquid phase section of said auxiliary tank.

* * * * *